United States Patent [19]

Myers

[11] 4,142,642

[45] Mar. 6, 1979

[54] COUNTERWEIGHT ASSEMBLY FOR EARTH-WORKING EQUIPMENT

[75] Inventor: Jimmy D. Myers, Morton, Ill.

[73] Assignee: Caterpillar Tractor Co., Peoria, Ill.

[21] Appl. No.: 851,004

[22] Filed: Nov. 14, 1977

[51] Int. Cl.[2] ..... E02F 9/18

[52] U.S. Cl. ..... 414/719; 414/686; 414/723; 414/918; 280/421; 280/759

[58] Field of Search ..... 214/127, 131 A, 138 R, 214/142, 145 A, DIG. 11; 212/48, 49; 280/420, 421, 759, 760

[56] References Cited

U.S. PATENT DOCUMENTS

| | | | |
|---|---|---|---|
| 3,077,999 | 2/1963 | Svoboda | 214/145 R |
| 3,329,225 | 7/1967 | Dunn | 280/421 X |
| 3,627,155 | 12/1971 | Van Der Zyl | 280/421 X |
| 3,991,891 | 11/1976 | Cox | 214/142 |
| 3,998,342 | 12/1976 | Myers | 214/142 |

*Primary Examiner*—L. J. Paperner

*Attorney, Agent, or Firm*—Wegner, Stellman, McCord, Wiles & Wood

[57] ABSTRACT

Hydraulic fluid conduits are disposed in a counterweight which is adapted to be secured between a tractor and an earth-working implement such as a backhoe. The counterweight has a tractor-engaging side and an earth-working implement-engaging side from which the conduits extend. The conduits are equipped with hydraulic couplings for mating with the hydraulic lines from the tractor and an earth-working implement.

14 Claims, 8 Drawing Figures

FIG. 2
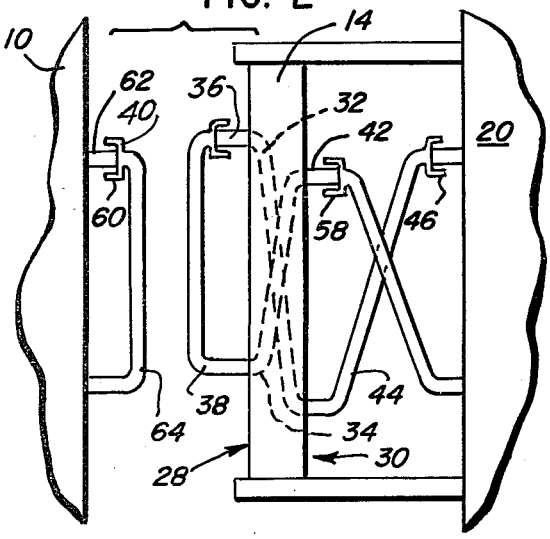
FIG. 3
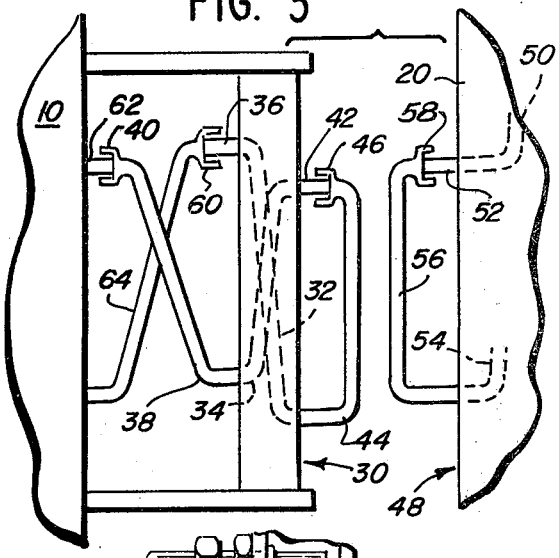
FIG. 1
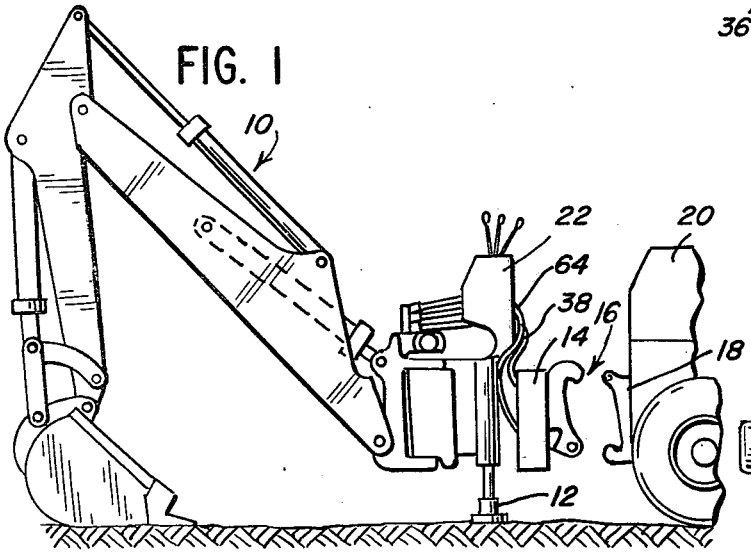
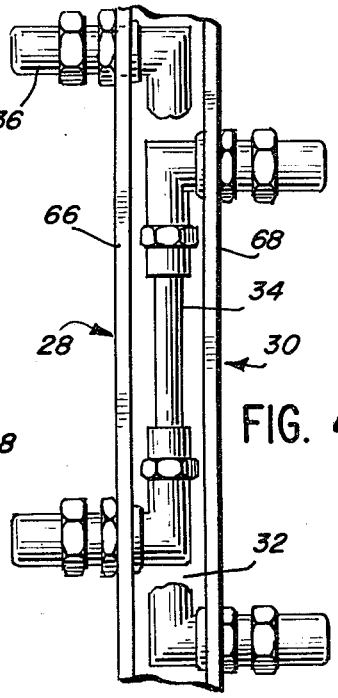
FIG. 4
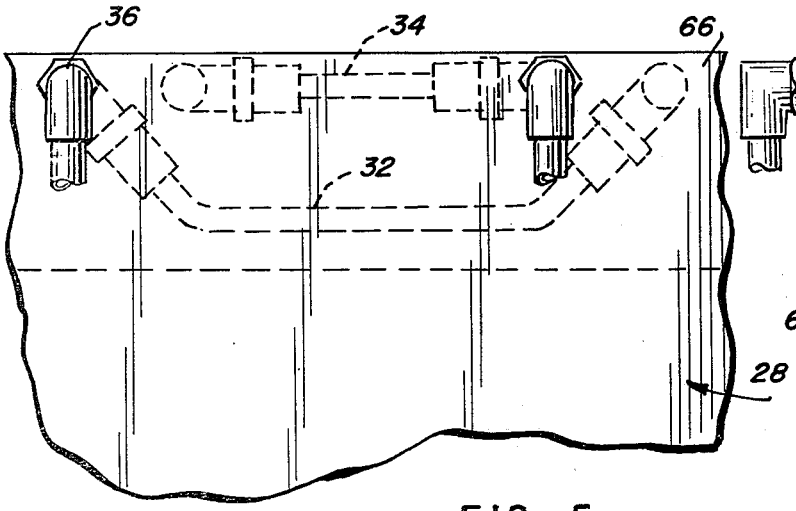
FIG. 5
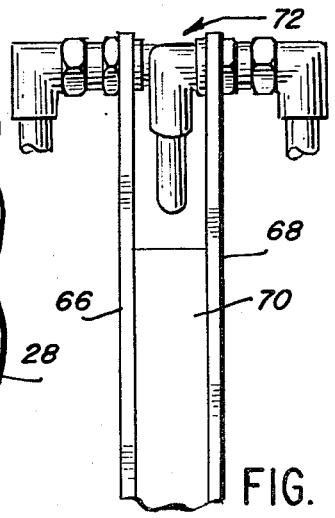
FIG. 6

COUNTERWEIGHT ASSEMBLY FOR EARTH-WORKING EQUIPMENT

BACKGROUND OF THE INVENTION

1. Field of the Invention

This invention relates to earth-working apparatus and, more particularly, to a counterweight assembly adapted to be connected to a tractor or an earth-working implement.

2. Description of the Prior Art

Counterweights are often used for counterbalancing purposes and are provided with apparatus for detachably securing the counterweight to a tractor and alternately to an earth-working apparatus such as a backhoe. When the backhoe has been removed from its vehicle, it is often desirable to place the counterweight on the rear of the tractor for improved stability.

For example, Myers U.S. Pat. No. 3,998,342, owned by Caterpillar Tractor Co., Peoria, Illinois, the assignee of the present invention, shows an improved counterweight structure for use in counterbalancing an earth-working machine. The counterweight assembly is removable from either the blackhoe or the tractor, or both. Also, the counterweight is adapted for selective mounting on a front loader bucket or a bulldozer blade by a support member.

The counterweight structure as shown by Myers is simple and economical and provides desirable features such as its ability to be detached from either the backhoe or the tractor, or both. The associated hydraulic lines between the two equipments must be connected and disconnected during mounting and demounting. This procedure is cumbersome and time-consuming and, if the operator is not careful to reconnect the open lines to each other when the equipments are detached from each other, a loss of hydraulic fluid may result.

SUMMARY OF THE INVENTION

The present invention is directed to overcoming one or more of the problems as set forth above.

According to the present invention, an improved counterweight assembly facilitates hydraulic interconnection between equipment. The counterweight assembly has hydraulic conduits disposed therethrough for transferring hydraulic fluid between the earth-working vehicle, such as a tractor, and the earth-working implement, such as a backhoe. The counterweight assembly has a tractor-engaging side and a spaced-apart earth-working implement-engaging side. The hydraulic fluid conduits extend from one side of the counterweight assembly to the other, transferring hydraulic fluid between the tractor and the earth-working implement. The conduits are complemented at alternate ends by male connectors and hoses with female connectors that serve to expedite selective interchange of coacting fluid conduits. The hoses are of a length and disposition that facilitate proper coupling with the coacting connector members whether the counterweight is being removed, attached or stored. Utilizing short and long coupled coacting fluid transfer means mounted respectively on the counterweight, backhoe and/or tractor allows sequential transfer of the counterweight in a most effective and convenient manner. Once coupled or detached, mating or coacting fluid conduit connector portions on these three prime components are successively coupled to form closed integrated operative work systems and/or safely sealed independent inactive circuits.

DRAWING

FIG. 1 is a fragmentary side elevation illustrating the counterweight in accordance with the present invention attached to a backhoe;

FIG. 2 is a fragmentary top view of a tractor wherein the counterweight contemplated by the invention is attached thereto;

FIG. 3 is a fragmentary top view of the backhoe wherein the counterweight contemplated by the invention is attached thereto;

FIG. 4 is a top view of the fluid conduits and the connectors, together with the counterweight contemplated by the present invention;

FIG. 5 is a front view of the conduits and connectors of the counterweight contemplated by the present invention;

FIG. 6 is a side view of the counterweight and its conduits;

DESCRIPTION OF PREFERRED EMBODIMENT

Figure 8:
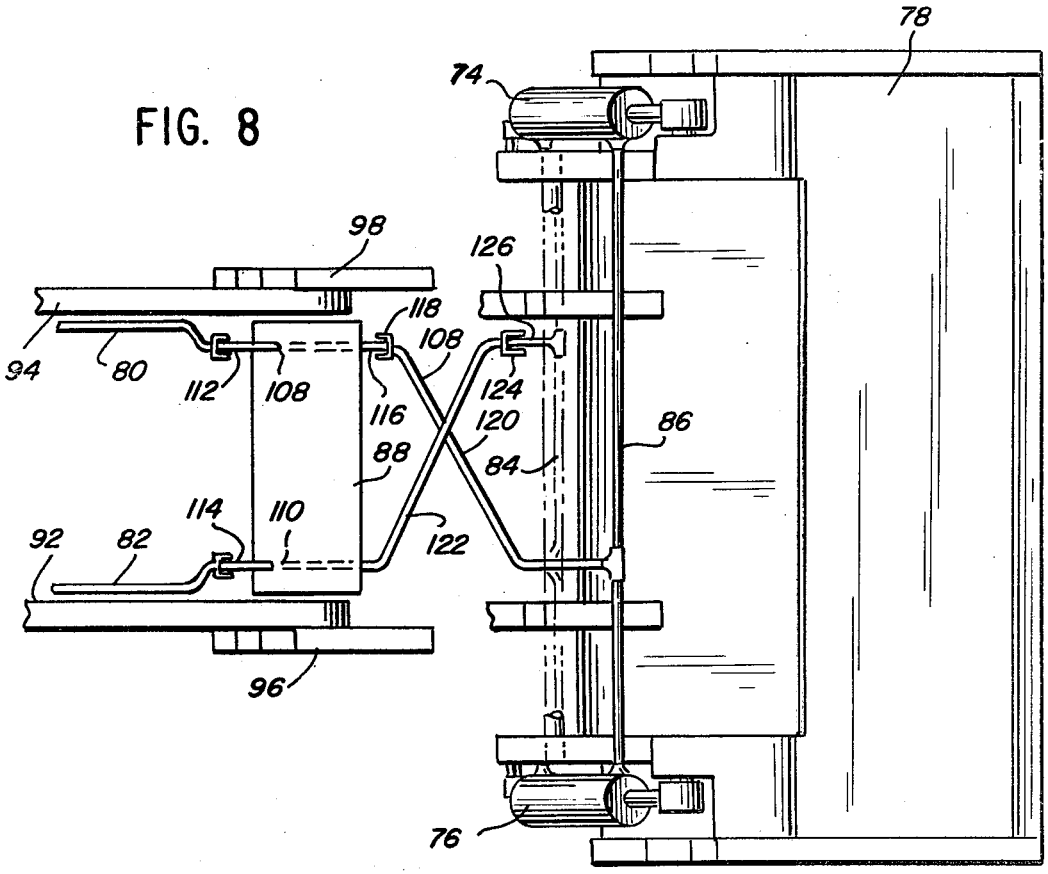
FIG. 8 is a top view of the manifold adaptor and the loader bucket shown in FIG. 7.

Referring to FIG. 1, a backhoe 10, resting on stabilization jacks 12, carries a counterweight 14 which is mounted thereon by brackets (not shown) for the selective removal from backhoe 10. Counterweight 14 has a downwardly opening hook and a subjacent pin assembly 16 which is adapted to mate with a support bracket 18 on a tractor 20. The backhoe 10 has a hydraulic control console 22 which is supplied with hydraulic fluid by flexible hoses 64 and 38 which extend from the console 22 through the counterweight 14 to the hydraulic lines of tractor 20, as will be explained in greater detail below.

Referring to FIG. 2, the counterweight 14 is shown to have a backhoe-facing side 28 and a tractor-facing side 30. Hydraulic fluid conduits 32 and 34 extend from the backhoe-facing side through the counterweight 14 to the tractor-facing side 30. A conduit 32 has a male connector 36 connected thereto on the backhoe-facing side 28. A flexible hose 38 is coupled to the conduit 34 on the backhoe-facing side. Flexible hose 38 has a female connector 40 at its end which is adapted to receive the male connector 36. Accordingly, the flexible hose 38 must be of sufficient length for the mating of connectors 36 and 40. Similarly, a male connector 42 is connected to the conduit 34 on the tractor-facing side 30. A flexible hose 44 is connected to the conduit 32 and has at its end a female connector 46 and is of the appropriate size to receive the male connector 42. Accordingly, a flexible hose 44 must be of a sufficient length for the mating of connectors 42 and 46. When the counterweight 14 is dismounted from the backhoe 10 and the tractor 20, connectors 36 and 40 are mated (as shown in FIG. 2) and connectors 42 and 46 are mated (as shown in FIG. 3).

The counterweight 14 is shown to be mounted or attached to the tractor 20 by the assembly 16 and the support 18. The hydraulic conduits from the tractor 20 are routed to the rear side 48 thereof. A fluid conduit 50 terminates in a male connector 52 which is mounted on the rear side 48 facing the backhoe 10. Similarly, a fluid conduit 54 terminates in a connector upon which is mounted a flexible hose 56 having a female connector 58 attached to its end. Female connector 58 is adapted to mate with connector 52. Hence, the length of the flexible hose 56 must be sufficient to provide for mating.

As shown in FIG. 2, the couplings and the flexible hoses between the counterweight 14 and the tractor 20 are interconnected. Specifically, the female connector 58 from the flexible hose 56 is coupled to male connector 42, and the female connector 46 from the flexible hose 44 is connected to male connector 52. Thus, there exists a passageway for fluid flow from conduit 50 to conduit 32 and from conduit 54 to conduit 34. Since the backhoe 10 is not coupled to the counterweight 14, female connector 40 is mated with male connector 36 to complete the hydraulic circuit through the counterweight 14. Thus it may be seen that there is a continuous hydraulic circuit between conduits 50 and 54. If the hydraulic lines from backhoe 10 are to be connected to the hydraulic lines of the counterweight 14, female connector 40 is interchanged with female connector 60, which is secured to a male connector 62 projecting from the rear side of the backhoe 10.

Referring to FIG. 3, the hydraulic connections between the backhoe 10 and the counterweight 14, as described above, are shown wherein female connector 60 on flexible hose 64 is coupled to male connector 36 and female connector 40 on flexible hose 38 is connected to male connector 62. After the hook and pin assembly 16 has been disconnected from the support structure 18, or prior to its disconnection, the flexible hoses and the connectors of the hydraulic lines between the counterweight 14 and the tractor 20 must be interchanged. Specifically, the female connector 46 at the end of flexible hose 44 from the counterweight 14 is connected with the male connector 42 and the female connector 58 at the end of flexible hose 56 is returned to its male connector 52. Thus, a closed hydraulic circuit between the conduits 50 and 54 on the tractor 10 is provided and a closed hydraulic circuit through the counterweight 14 and the backhoe 10 is also provided.

Referring to FIGS. 4-6, the construction of counterweight 14 will now be described. Two flat, spaced-apart plates 66 and 68 form the backhoe-facing side 28 and the tractor-facing side 30 on their outer surfaces. The plates are spaced apart by a sufficient distance to accommodate a counterweight material 70. Plates 66 and 68 extend upwardly from the counterweight material 70 to provide a channel 72 which accommodates the conduits 32 and 34 and their mounting hardware. The conduits 32 and 34 may be routed through the counterweight 14 in any acceptable manner. It is particularly advantageous, however, to provide the channel 72 free of counterweight material 70 so that broken or malfunctioning connectors and conduits can be easily repaired.

Figure 7:
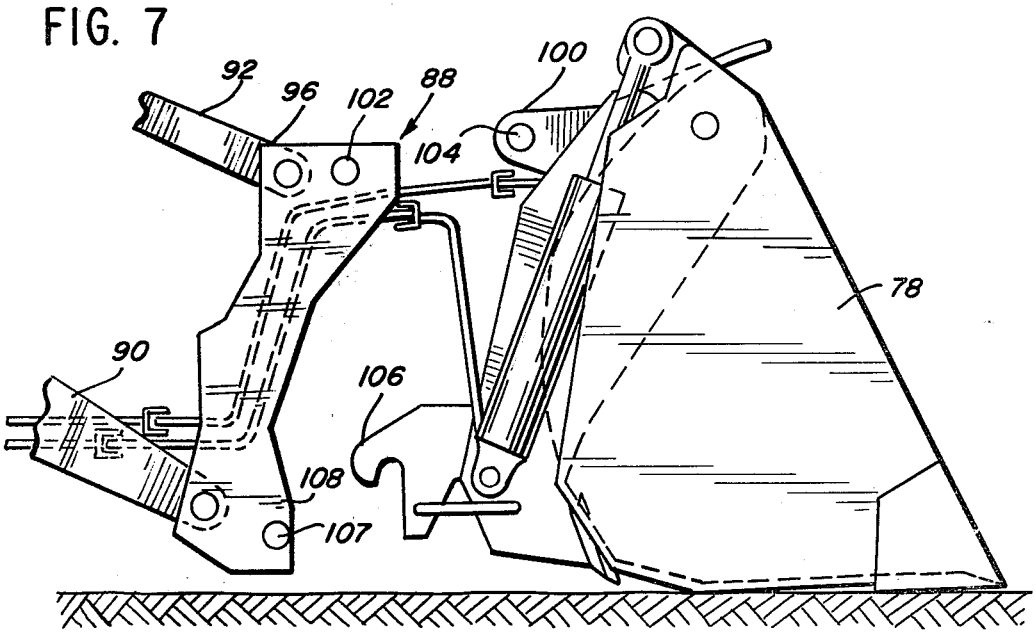
FIG. 7 is a side view of a manifold adaptor having interconnecting fluid conduits therethrough for a loader bucket.

Referring to FIGS. 7 and 8, an extension of the concept shown in FIGS. 2-4 includes the use of the hydraulic interconnection system without a counterweight. This system is particularly useful for quick change devices of loader implements. Hydraulic cylinders 74 and 76 mounted on a bowl 78 require hydraulic power from a tractor (not shown). The hydraulic power is provided from the tractor by conduits 80 and 82 which are to be ultimately coupled to conduits 84 and 86 feeding the hydraulic cylinders 74 and 76.

In the past, flexible hoses have been used to connect the conduits 80 and 82 with the conduits 84 and 86, respectively. This particular arrangement is at times inconvenient, especially when a variety of different loader implements are to be interchanged. To facilitate the interchangeability of various loader implements, a manifold adaptor 88 may be secured to the lift arms, generally shown at 90, and the tilt arms 92 and 94. The manifold adaptor 88 has two end plates 96 and 98 adapted for movement about the lift and tilt arms. A bracket 100 is secured to the adaptor 88 by a pin which extends through bores 102 and 104 when the downwardly opening hook 106 engages pin 107.

Conduits 108 and 110 traverse the manifold adaptor 88. The conduits are provided with suitable connectors 112 and 114 to mate with the conduits 80 and 82 from the tractor. A male connector 116 extends outwardly from the manifold adaptor 88 to receive the female connector 118 which is connected to a flexible hose 120 from the conduit 86. Similarly, a flexible hose 122 is coupled to conduit 110 and has a female connector 124 at its end. Female connector 124 is shown to engage conduit 84 at a male connector 126. When and if it is desired to remove the bowl 78 from the adaptor 88, the female connector 124 is removed from the male connector 126 and the female connector 118 is removed from the male connector 116, and the two female connectors are interchanged. Specifically, the female connector 124 is connected to the male connector 116 and the female connector 118 is connected to the male connector 126. A closed hydraulic circuit is provided from the conduit 80 to the conduit 82 through the conduits 108 and 110 through the flexible hose 122. Also, the fluid which remains within the hydraulic cylinders 74 and 76 and the conduits 84 and 86 is retained therein since female connector 118 and the flexible hose 120 are coupled to the male connector 126.

The embodiments of the invention in which an exclusive property or privilege is claimed are defined as follows:

1. A counterweight system adapted to be secured between a tractor having a fluid pressure supply and an earth-working implement having a pressurized fluid operable mechanism, said system comprising:
   - a counterweight having a tractor-engaging side and an earth-working implement-engaging side;
   - means for securing the counterweight to a tractor;
   - means for securing the counterweight to the earth-working implement; and
   - hydraulic fluid conduits in said counterweight extending from said tractor-engaging side to said earth-working implement-engaging side and having means at the opposite ends thereof for connection of said conduits between said fluid pressure supply and said fluid operable mechanism.

2. The counterweight system of claim 1 wherein said hydraulic fluid conduits are equipped with hydraulic couplings for mating the hydraulic lines from said tractor and/or said earth-working implement.

3. The counterweight of claim 2 wherein a flexible hydraulic hose is attached to said second end of said first conduit and a hydraulic connector is attached to said second end of said second hydraulic conduit for mating with said hose attached to said second end.

4. The counterweight of claim 2 wherein a flexible hydraulic hose has a female connector on one end thereof, the other end of said hose is attached to said first end of said first conduit, and a male hydraulic connector is attached to said first end of said second conduit.

5. The counterweight of claim 2 wherein a flexible hydraulic hose has a female connector on one end thereof, the other end is attached to said second end of said second conduit, and a male hydraulic connector is attached to said second end of said first conduit.

6. The counterweight system of claim 1 wherein said fluid conduits include a first and a second fluid conduit, each having a first and a second end, the first end of each conduit extending outwardly from said tractor-engaging side and said second end of each conduit extending outwardly from said earth-working implement-engaging side.

7. The counterweight of claim 1 wherein said hydraulic fluid conduits are equipped with hydraulic couplings for mating with hydraulic lines from said tractor and/or said earth-working implement.

8. The counterweight of claim 7 wherein the length of said flexible hose is sufficient to connect said female connector with said male connector.

9. The counterweight of claim 1 wherein said fluid conduits include a first and a second fluid conduit each having a first and a second end, the first end of each conduit extending outwardly from said tractor-engaging side and said second end of each conduit extending outwardly from said earth-working implement-engaging side.

10. The counterweight of claim 9 wherein the length of the flexible hose is sufficient to connect said female connector with said male connector.

11. The counterweight of claim 1 wherein a flexible hydraulic hose is attached to said first end of said first conduit and a hydraulic connector is attached to said first end of said second conduit for mating with said hose attached to said first end.

12. The counterweight of claim 1 wherein the earth-working implement is a backhoe.

13. In a counterweight adapted to be secured between a tractor and an earth-working implement, the counterweight having a tractor-engaging side and a spaced-apart earth-working implement-engaging side, the improvement comprising:

hydraulic fluid conduits disposed in said counterweight and extending from the tractor-engaging side to the earth-working implement-engaging side for transferring hydraulic fluid between said tractor and said earth-working implement.

14. In a counterweight assembly adapted to be secured between a tractor and a backhoe, the counterweight having a tractor-facing side and a spaced-apart backhoe-facing side, the improvement comprising:

a first and a second hydraulic conduit, each conduit having a first and a second end, said conduits extending through said counterweight assembly from said tractor-facing side to said backhoe-facing side;

hydraulic connectors attached to said first end of said first and second conduits; and flexible hydraulic hoses each having a connector secured to said second end of said first and second conduits for mating with said hydraulic connectors.

* * * * *